US009446935B2

(12) United States Patent
Ruoss

(10) Patent No.: US 9,446,935 B2
(45) Date of Patent: Sep. 20, 2016

(54) METHOD FOR MONITORING CRANE SAFETY AND CRANE

(71) Applicant: Liebherr-Werk Ehingen GmbH, Ehingen/Donau (DE)

(72) Inventor: Oliver Ruoss, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 54 days.

(21) Appl. No.: 13/915,114

(22) Filed: Jun. 11, 2013

(65) Prior Publication Data

US 2013/0345938 A1 Dec. 26, 2013

(30) Foreign Application Priority Data

Jun. 13, 2012 (DE) ..... 10 2012 011 726
Jun. 13, 2012 (DE) ..... 10 2012 011 871

(51) Int. Cl.
*B66C 23/88* (2006.01)
*B66C 13/18* (2006.01)
*B66C 23/90* (2006.01)

(52) U.S. Cl.
CPC ..... *B66C 23/88* (2013.01); *B66C 13/18* (2013.01); *B66C 23/905* (2013.01)

(58) Field of Classification Search
CPC ..... B66C 1/00; B66C 17/00; B66C 2700/01; B66C 2700/03; B66C 2700/06; B66C 2700/08; B66C 13/18
See application file for complete search history.

(56) References Cited

U.S. PATENT DOCUMENTS 5,217,126 A 6/1993 Hayashi et al.
5,730,305 A * 3/1998 Ichiba et al. ..... 212/276
5,823,370 A * 10/1998 Ueda ..... 212/276
5,929,389 A * 7/1999 Keuper ..... 177/141
6,744,372 B1 6/2004 Shaw et al.
2007/0023377 A1 2/2007 Abel et al.
2007/0034587 A1 2/2007 Morath
2008/0053945 A1 3/2008 Schneider et al.
2012/0095653 A1* 4/2012 Morath et al. ..... 701/50

FOREIGN PATENT DOCUMENTS

CN 101 348 216 A 1/2009
DE 10 2005 035460 A 2/2007
DE 20 2006 017730 U1 4/2008
DE 10 2008 021627 A 11/2009

* cited by examiner

*Primary Examiner* — John R Olszewski
*Assistant Examiner* — Nicholas K Wiltey
(74) *Attorney, Agent, or Firm* — Dilworth & Barrese, LLP.

(57) ABSTRACT

The invention relates to a method for monitoring the crane safety of a crane with a variable support base and with a monitoring unit, wherein several safety criteria are monitored during crane operation, in that, for each criterion which is dependent on at least one parameter relating to the crane configuration and/or crane movement during crane operation, an admissible specific limit value is calculated during crane operation, and monitored for compliance. In addition, the invention relates to a method for operating a crane with a monitoring unit which calculates an admissible bearing load dependent on one or more modifiable parameters, during the operation of the crane, and a sensor system which detects the current modifiable parameters during crane operation, and makes them available to the monitoring unit, wherein one or more sensor values are modified before the calculation of the admissible bearing load, in order to determine the admissible bearing load for one or more future parameters.

25 Claims, 10 Drawing Sheets

METHOD FOR MONITORING CRANE SAFETY AND CRANE

BACKGROUND OF THE INVENTION

The invention relates to a method for monitoring the crane safety of a crane, as well as to a crane with a variable support base.

It is known to monitor crane safety by means of a crane control system during crane operation. Ensuring crane safety is based on complying with various safety criteria. Examples of possible safety criteria are the component strength of jib systems, hoist ropes, load hooks, slewing ring, luffing cylinder, mechanical connections, etc., on the one hand, and the stability of the crane, on the other hand. Criteria pertaining to the stability of the crane are, for example, the tilting of the crane in the load direction, the tilting of the crane in the direction opposite the load direction, wind speed, the planned upper carriage rotation angle, etc. For each one of these criteria, admissible limit values can be determined, which have to be monitored separately for compliance to ensure crane safety during the operation of the crane.

The monitoring process is carried out automatically by an implemented crane control system, in particular by the load moment device of the crane. Monitoring events can be displayed, and they can optionally lead to intervention in the crane movement.

During the manufacture and the verification of the crane, to begin with, so-called load charts are calculated for all the mentioned criteria, the chart entries of which define the maximum admissible bearing loads for concrete crane configurations.

As a rule, a crane is operated in a supported state, wherein the size of the support base is dependent on the extension state or deployment state of the rail spars or collapsible spars of the support device. If a symmetric support is impossible due to the installation site, EP 0 779 238 B1 proposes to reduce the entire supporting base to the smallest present deployed state or collapsed state. The disadvantage of this approach is that actually present bearing load is lost in large portions of the upper carriage rotation angle. In addition, in this embodiment, the position of the rail spars or collapsible spars is limited to predetermined concrete positions, since the operation of the crane is admissible only for a limited number of support positions.

EP 0 779 238 B1 proposes an alternative solution. This solution establishes individual rotation angle ranges for the upper carriage, and it indicates a uniform maximum bearing load for each range. This determined maximum bearing load in each case corresponds to the smallest bearing load admissible in the individual ranges. In this solution as well, due to the jump between the rotation angle ranges, actually present bearing load is lost.

An alternative approach is known from DE 20 2006 017 730 U1. The above-mentioned safety criteria are no longer monitored exclusively on the basis of previously calculated and stored load charts; instead, some of said criteria are also monitored individually in comparison to the values currently existing on the crane. As a result, a certain diversity in the monitoring of the crane is achieved; however, the maximum possible bearing load cannot be exhausted due to the recourse to individual load charts.

DE 10 2005 035 460 A1 proposes to extract, from the existing load charts, individual support points for certain crane states, and, on the basis of these support values, to determine the actually existing maximum bearing load by interpolation. Again, the determined admissible bearing load is affected by a certain amount of imprecision, which may lead to an appreciable loss of maximum bearing load.

The embodiment variants known from the prior art have in common that previously calculated load charts are always used. However, a variable crane configuration, in particular a variable support base, leads to an infinite number of possible crane configurations and corresponding load charts. It is desirable to be able to design the crane configuration as flexibly as possible, particularly at the site of use.

Known cranes are operated in such a manner that the parameters can be modified until the admissible bearing load corresponds to the actual bearing load or exceeds the latter. The crane control system is used to prevent moving the crane into an inadmissible range and it prohibits further crane movements that would lead to exceeding a limit. The admissible bearing load is determined in each instance on the basis of the stored load charts. However, if one deviates from the usual practice with previously calculated load charts, these necessary fixed limit values are missing, and it is not possible moreover to define fixed intervention limits and warning limits.

If this limit is nevertheless exceeded during crane operation, possibly owing to a change in weather conditions, then the crane is in the inadmissible operating range. In order to reduce the associated hazards, an intervention of the load moment device in the crane control system occurs, the results of which may include the complete blocking of all crane movements.

To date, a so-called key-operated switch has been provided, which allows the performance of crane movements without or with an only partially active load moment device. This function was useful for readying the crane for work, or also for moving it out of an inadmissible operational range, for example, when the load moment device has stopped a crane movement.

Now, if a key-operated switch is no longer incorporated, the crane movements can be carried out only if they occur in the admissible bearing load range. However, if the crane has been moved into an inadmissible range, then the load moment device interrupts the current crane movement and blocks all further crane movements.

SUMMARY OF THE INVENTION

This problem is solved by a method according to the features herein. Further advantageous embodiments of the object are the subject matter of the following features.

A method is proposed for monitoring the crane safety of a crane with a variable support base, as well as with a monitoring unit. The support base is determined from the deployed or collapsed state of the support device. The monitoring unit monitors several safety criteria during crane operation to ensure crane safety.

The individual safety criteria can relate to the component strength, component loading as well as the stability of the crane, for example. They include in particular the tilting of the crane in the load direction, the tilting of the crane in the direction opposite the load direction, tearing of the hoist rope, the component strength of the jib system, wind speed, the load limits of the under carriage, the strength of the load hook, the slewing ring load, the luffing cylinder strength, the strength of the mechanical connections as well as the rotation angles of the upper carriage with jib that are to be used during crane operation.

Concrete calculation examples for the monitoring of the individual criteria are, for example, the small test load, the large test load, loss of hook load, tilting angle, tilting backward without load, as well as a total of many more than 30 criteria. Individual criteria can be specified, for example, in a corresponding DIN standard.

According to the invention, it is now provided that the monitoring unit calculates for each criterion, which is dependent on at least one parameter relating to the crane configuration and/or crane movement during crane operation, an admissible specific limit value during crane operation. Accordingly, the taking into consideration of a load chart for corresponding criteria is entirely dispensed with.

A criterion is dependent on at least one parameter relating to the crane configuration and/or crane movement during crane operation, as soon as the actual crane configuration at the site of use or during crane operation has an influence on the compliance with the criterion. This also includes, besides the equipment configuration, each crane movement that has an influence on a corresponding criterion. For example, the current jib positions, the support base, the upper carriage rotation angle, etc.

At least one specific limit value represents the admissible specific bearing load up to which a corresponding criterion has to be complied with and the crane safety is not endangered.

The individual specific limit values or admissible specific bearing loads can be monitored separately during the operation of the crane and compared with the actually existing crane state values. Alternatively or additionally, it can be advantageous to determine a common admissible bearing load from the individual admissible specific limit values or bearing loads. In this case, a common maximum admissible bearing load is determined for each crane state or crane configuration.

By calculating the criteria on the crane, one gets, in each situation, the maximum admissible bearing load, which are [sic] derived from the criteria for the current situation. This is the remarkable advantage in comparison to previously calculated charts, which always represent a minimum over certain dimensions and which can never completely exhaust the potential bearing load of the crane. The criteria, which are no longer calculated beforehand, are calculated according to the invention during the run-time, that is during the operation of the crane, on the crane. Implementing the method according to the invention now leads to a method or to a monitoring device which allows and simultaneously monitors any desired support base, i.e., any desired position of the support spars. Although any desired position was mechanically possible in the past, such a position was not always protected in each case by the monitoring device.

For the calculation of the commonly admissible bearing load, it can be advantageous to subdivide the individual criteria into at least two different criteria types. For example, the individual criteria can be subdivided into linearly dependent as well as linearly independent criteria types. Linearly dependent means that such a criterion depends on at least one additional criterion. In particular, at least one linearly dependent criterion can be dependent on at least one calculated specific limit value/bearing load of at least one additional linearly dependent and/or linearly independent criterion.

A particularly advantageous embodiment of the method results from calculating in a first step the admissible specific bearing load for each linearly independent criterion. From the value of the specific bearing loads for the linearly independent criteria, the minimum of this bearing load is determined subsequently. The admissible bearing load of the linearly dependent criteria is determined by iteration. It is conceivable for the iteration to start with the minimum of the admissible bearing loads of the linearly independent criteria, and to determine a minimum of the bearing loads of the linearly dependent criteria, which at the same time corresponds to the common admissible bearing load for the crane.

In order to speed up the method for determining the admissible bearing load, it is possible, for example, to use the section method, in particular the repeated bisection method. As a result, the calculation time needed to determine the admissible bearing load can be reduced.

In addition to the method according to the invention, the possibility exists to store one or more load charts in a memory unit of the crane, and to take them into consideration for monitoring the crane. However, the stored load charts are exclusively charts that are not dependent on a parameter relating to the crane configuration and/or crane movement during crane operation. When preparing the load charts, all the criteria that are dependent on at least one parameter relating to the crane configuration during crane operation are excluded. Consequently, primarily strength-relevant bearing load delimitations are stored on the crane as previously calculated load charts. Said charts contain limit values which, when complied with, prevent lasting damage to the crane due to mechanical overloading, for example, due to a load uptake.

A method is proposed for operating a crane with a monitoring unit, wherein the monitoring unit calculates an admissible bearing load dependent on one or more modifiable parameters during crane operation. The method according to the invention does not require a load chart or a complete load chart. The calculation takes place during crane operation on the crane. It is particularly preferable for the calculation of the admissible bearing load to be performed according to the above-described method of the invention. However, this method can also be implemented independently.

The current modifiable parameter(s) is (are) user-defined. One or more parameters characterize, for example, the current crane configuration, or the executed crane movements or activities. The parameter can be a parameter relating to the position of the crane or of a crane component.

At least one of the parameters can be the jib length, the jib angle, the direct ballast radius and/or the rotation angle of the slewing ring. As indicated, these are examples, and obviously other parameters are also conceivable.

In addition, a sensor system is provided, which detects the current modifiable parameters during crane operation and makes them available to the monitoring unit. According to the invention, it is provided that one or more sensor values are modified before the calculation of the admissible bearing load. In this manner, it is possible to determine the admissible bearing load for one or more future parameters.

The method according to the invention consequently allows a forward-looking calculation of the possible admissible bearing load for future crane movements. The monitoring unit of the crane thus calculates in real time on the crane and at any time which admissible bearing loads occur when the currently executed crane movements are continued in the near future. Moreover, extensive prognoses for the development of the future admissible bearing load depending on current and future crane activities can be established. These procedures can be necessary, in particular, if no fixed limit values, i.e., load charts, exist for monitoring the crane. It is preferable for the crane to calculate, always in parallel to the method according to one of Claims 1-8, a preview showing how the admissible bearing load changes, if the current actual movement or currently possible crane movement continues to be executed.

The method according to the invention does not require extensive enhancement of an existing crane or of a monitoring unit. Rather, minor modifications are sufficient to adapt existing systems for the implementation of the method. Only a means for manipulating the detected sensor values needs to be provided.

It is particularly advantageous if the monitoring unit, depending on the calculated admissible bearing load, modifies at least one parameter during crane operation, in order to control the admissible bearing load. For example, the rate of the parameter change can decrease continuously or stepwise, or stop, before a parameter value is reached at which the admissible bearing load corresponds to the actual bearing load. Thus, the monitoring unit reacts, as soon as the bearing load changes in the direction toward zero. A dependent crane movement can be slowed or stopped in time, in order to prevent exceeding the admissible bearing load. Alternatively or additionally, an indication or display can occur, showing the operator that an overstepping has possibly taken place or that a situation of overstepping is being approached.

Depending on the result of the preview, the desired target movement of the crane is approved, limited, or completely blocked. An essential characteristic here is the steepness of the change of the admissible bearing load. This calculation occurs using all the relevant sensors.

The decrease can occur continuously or also stepwise. The decrease of the rate can occur, for example, in such a manner that, at the time of or before the reaching of the agreement between admissible and actual bearing load, said rate is reduced in steps to zero from a value that is reduced in comparison to the other change rate, or so that the value of zero is reached by a continuous decrease of the rate.

It can be provided that the rate of the parameter change is decreased continuously or stepwise, starting at a difference between actual and admissible bearing load, i.e., over a certain remaining distance.

This difference can assume a constant value or a value which depends on the actual and/or admissible bearing load or on their difference, or on the ratio of this difference to the actual and/or admissible bearing load.

It is particularly advantageous if the change of the parameter(s) is carried out in such a manner that the actual bearing load cannot exceed the admissible bearing load.

In a particularly advantageous embodiment of the invention, it can be provided that, as a result of a targeted modification of at least one sensor value, a verification is carried out to determine which parameter change or parameter changes lead(s) to a decrease of the actual bearing load and/or to an increase of the admissible load. This advantageous embodiment of the invention is particularly advantageous if the crane is already in an inadmissible operating range, i.e., the current bearing load has exceeded an admissible bearing load or corresponds to an admissible bearing load. In this case, the method indicates preferred crane movements which allow a particularly rapid and safe move out of the inadmissible range.

It is preferable that all crane movement is stopped as soon as the current bearing load exceeds or corresponds to the admissible bearing load. Subsequently, one or more possible parameter changes, i.e., crane movements, are indicated for selection to the crane operator, for the purpose of being able to move the crane safely and reliably out of the inadmissible range.

It can be sufficient to indicate a possible parameter change to the crane operator. However, it is better to make a selection of possible parameter changes available to the operator.

In addition, it is advantageous to approve only those parameter changes through the crane control system which allow a safest and fastest possible movement out of the inadmissible operating range. Remaining crane movements or parameter changes are limited or completely blocked.

In addition to at least one of the above-mentioned methods, it is possible to provide that an integrated crane use planner is used for the diversified crane monitoring during crane operation. The crane planner preferably uses stored limit curves or envelope curves for at least a portion of the crane parameters. Accordingly, two independent crane monitoring methods exist in order to ensure, on the one hand, monitoring redundancy, and, on the other hand, to verify in each case the functional capacity of the total system, by having the two monitoring methods that are provided independently of each other verify the functional capacity of the other monitoring method. In this context, reference is made to the entire content of DE 10 2008 021 627.

The invention further relates to a crane with a monitoring device. According to the invention, the monitoring device carries out at least one of the above-described methods according to the invention or an advantageous embodiment of the methods according to the invention. The advantages and properties of the crane obviously correspond to those of the method according to the invention, and therefore a renewed description is omitted here. It is particularly preferable to carry out the two methods in combination.

Moreover, the invention relates to a crane monitoring device, in particular to a load moment device, for carrying out at least one of the methods according to the invention or an advantageous embodiment of the method.

A further aspect of the invention relates to a data storage medium with stored software for carrying out at least one of the methods according to the invention or an advantageous embodiment of at least one of the methods on a crane monitoring device. The advantages and properties of the crane monitoring device or of the data storage medium obviously correspond to those of the method according to the invention, and therefore a repeated description is omitted here as well.

BRIEF DESCRIPTION OF THE DRAWINGS

Additional advantages and properties of the invention are explained in further detail in reference to drawings. The figures show.

DESCRIPTION OF THE PREFERRED EMBODIMENTS

Figure 1:
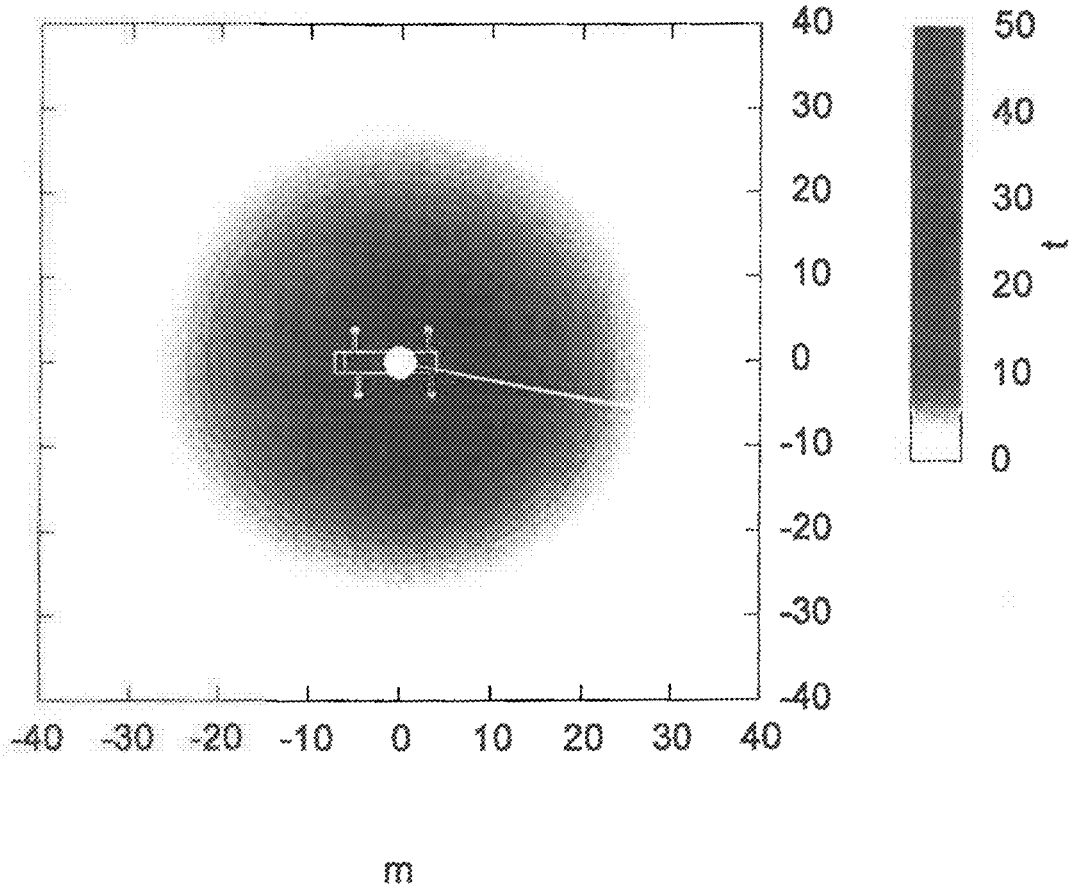
Fig. 1 prior art
FIGS. 1-4: a graphic representation of the bearing load distribution depending on the upper carriage rotation angle or on the maximum radius, calculated using a method of the prior art.

FIGS. 1-8 show the distribution of the admissible bearing load of a crane, depending on its radius or on the upper carriage rotation angle. The crane sketched in the center comprises a lower carriage, an upper carriage rotatably attached to the lower carriage, and a variable support. The variable support comprises a total of four rail spars which can be deployed in different support positions. In addition, a crane jib which can be luffed and which may have a telescopic design is arranged on the upper carriage. During crane operation, the current crane load depends on the rotation angle of the upper carriage as well as on the load radius, i.e., the luffing angle of the jib.

A monitoring unit of the crane monitors the compliance with the admissible bearing load during the operation of the crane. In particular, as a result of the method according to the invention, any desired position of the support spars is not only authorized but also monitored at the same time by the monitoring device.

The crane or the monitoring unit uses few load charts that contain the strength-relevant bearing load limitations of the crane. Their purpose is, for example, to prevent permanent damage to the crane due to mechanical excess loads. For safety criteria that depend on one or more operating parameters of the crane, the calculation of the admissible bearing load occurs during the run-time on the crane by the monitoring device, i.e., during crane operation. Among others, the following criteria are calculated:

Small test load according to DIN 15019, Part 2
Large test load according to DIN 15019, Part 2
Loss of hook load according to DIN 15019, Part 2
Tilting angle according to DE 13000, Appendix F
Tilting rearward without load according to BS 1757 and ISO 43053.3.2

In addition, a total of more than 30 criteria can be calculated. The calculation of the criteria on the crane makes it possible to exhaust the maximum possible bearing load in each situation, and not to have to take into consideration a lack of precision due to interpolation or estimation, which for safety reasons always requires a conservatively determined admissible bearing load.

For the calculation of the admissible bearing load, the criteria are divided into different, i.e., at least two different, calculation types. For example, a linearly independent calculation type is appropriate for the calculation of the large test load. The large test load is calculated by means of the following formula $$TL = \frac{\text{Tilting load} - 0.1 * Jib \text{ head weight}}{1.25}$$

where the tilting load represents the load at which the crane tilts over, and the outlier head weight is defined by a defined weight proportion of the jib. For the linearly dependent calculation type, it is possible to use, for example, the criterion of the small test load which is calculated according to the formula $$TL = \frac{\text{Tilting load} - Hdyn - W(TL)}{1.1}.$$

Here the tilting load again represents the load at which the crane tilts. Hdyn characterizes the dynamic live load factor. W introduces the effect of the wind into the calculation, an effect which is calculated taking into consideration the bearing load. Accordingly, the small test load is dependent on the calculated bearing load of at least one criterion, which is referred to as linearly dependent. It is also conceivable for the calculation to be recursive. For the calculation of the wind effect, one can assume, for example, a 1.2 $m^2$ area exposed to wind per 1 ton bearing load.

The algorithm for the calculation divides the criteria into linearly dependent and linearly independent criteria. In the first step, for each linearly independent criterion, the admissible bearing load is determined. Subsequently, the minimum of this $TL_{CriteriaA}$ of these bearing loads is determined and recorded.

In a second process step, an iteration of the admissible bearing load with the previously determined minimum $TL_{CriteriaA}$ as starting value is carried out. In the iteration, the linearly dependent criterion is verified in each step to determine its reliability. If the criterion is admissible, a move to the next criterion takes place. As soon as a criterion is no longer admissible, a move to the next iteration step in the criterion in question takes place, without carrying out an additional verification of the remaining criteria in the process.

Using this new bearing load TL, the second step is started again. This occurs until the second step yields a reliable bearing load $TL_{CriteriaB}$ for all the criteria. This now becomes the admissible maximum bearing load TL. After performing the n iteration steps, the method according to the invention should yield a value as large as possible for the admissible bearing load TL. The determination of the bearing load TL can also be carried out by repeated bisection.

The advantages of the invention will be explained in reference to the representations of FIGS. 5-8 as well as the bearing load representations according to the prior art (FIGS. 1-4).

The scale in the left margin of the image assigns corresponding bearing load values to the gray values. The crane configurations of FIGS. 1 and 5, 2 and 6, 3 and 7, as well as 4 and 8, are identical in each case and used for the comparison.

Figure 2:
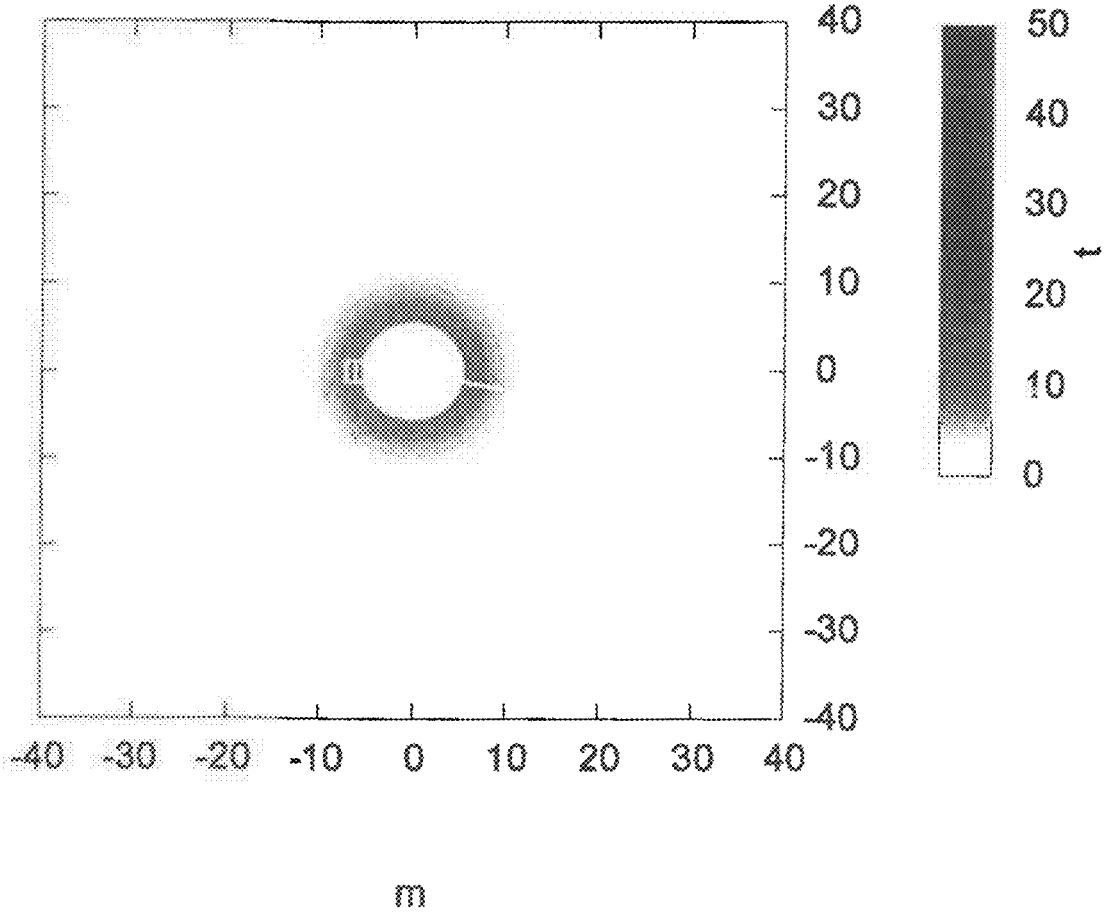
Fig. 2 prior art

In all the figures, three telescopic sections of the jib system are deployed 46%. The rail spars of the support are completely deployed in the crane configuration according to FIGS. 1 and 5 and allow a maximum support base. In contrast, the configuration of FIGS. 2 and 6 provides for operating the crane without support, and for leaving the rail spars completely retracted. The crane according to FIGS. 3 and 7 works with limited support, wherein two rail spars located on one crane side are completely deployed and the facing spars are completely retracted. The crane configuration of FIGS. 4 and 8 provides for crane operation with three completely deployed and one retracted rail spar.

The representation of the admissible bearing load in FIGS. 5-8 is based on a calculation during the crane operation on the basis of the method according to the invention, while the representation of FIGS. 1-4 is based on the use of load charts that were prepared before the operation of the crane with the aid of a usage planner.

The comparison of FIGS. 2 and 6 in particular shows the essential gain in bearing load that can be achieved using the method according to the invention. The method according to the prior art assumes a minimum support base for the total circumference of the rotation angle, while the method according to the invention calculates said base exactly during crane operation, and thus obtains different admissible bearing loads over the rotation angle range. In particular, no admissible bearing load is lost on the front and rear sides of the crane, because in this rotation angle range the missing support device is compensated by the crane length dimension, and it is thus higher than in the side area of the crane.

Of interest is not only the outer contour of the bearing load curve, but also the inner contour, i.e., the white field about the rotation axis of the upper carriage. This range shows the inadmissible range, because tilting rearward can occur here due to the crane ballast. In this case as well, according to FIG. 6, this inadmissible range can be reduced clearly compared to the range of FIG. 2.

Figure 5:
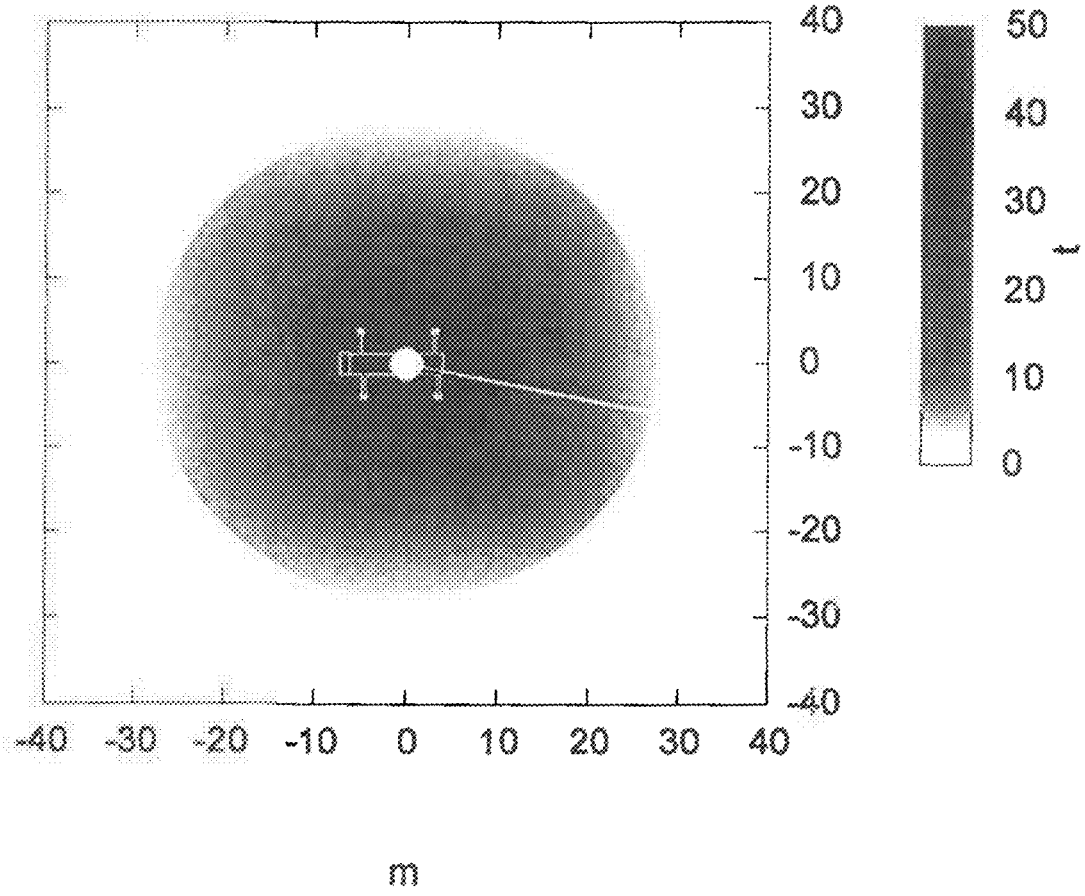
FIGS. 5-8: a graphic representation of the bearing load distribution depending on the upper carriage rotation angle as well as on the maximum radius, calculated using the method according to the invention.
Figure 6:
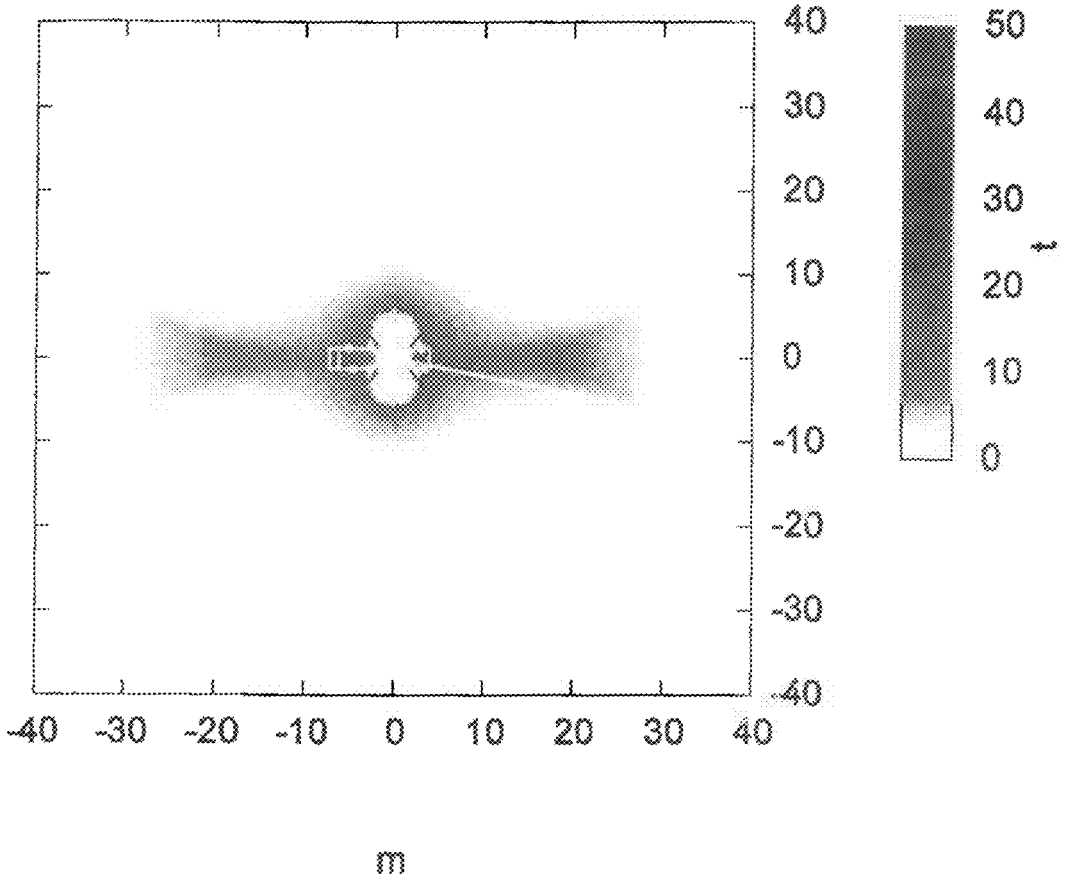
Figure 7:
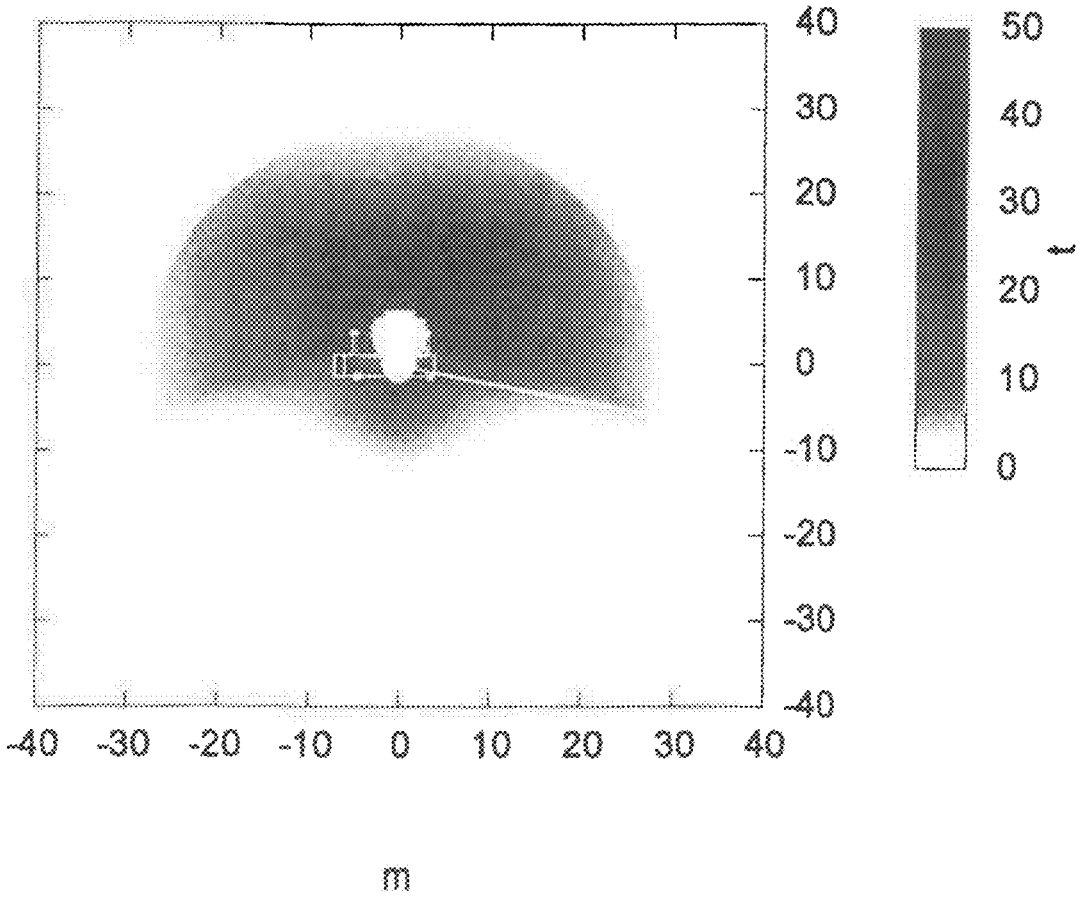
Figure 8:
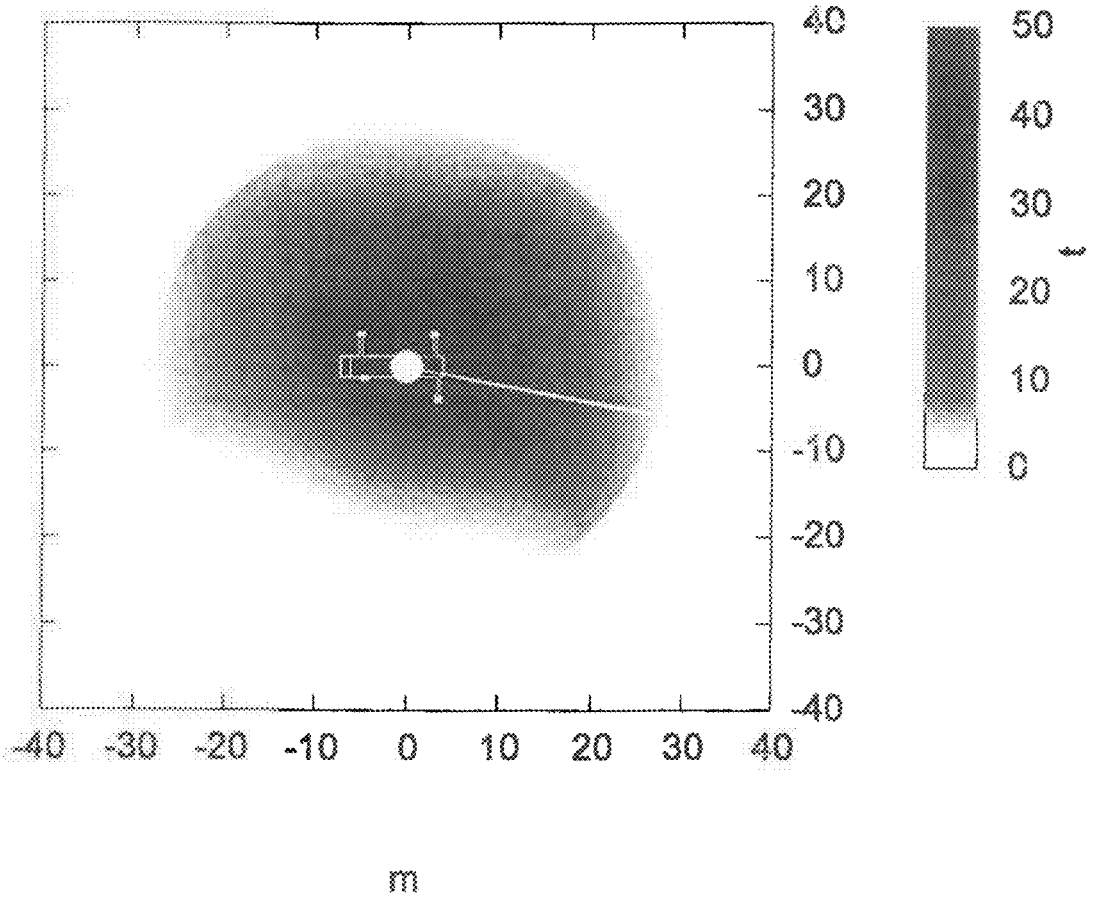

The gain of admissible bearing load due to the optimized calculation can also be seen clearly in the remaining FIGS. 5, 7 and 8. The outer contour here, too, clearly shows the gain of bearing load. In the range in which the jib is located above one of the rail spars, i.e., on the crane diagonal, there is also a substantial gain in bearing load.

In FIG. 5, the darker area with greater bearing load forms almost a square with concave sides. The admissible bearing load is increased in particular along the diagonal compared to the variant of FIG. 1.

Figure 3:
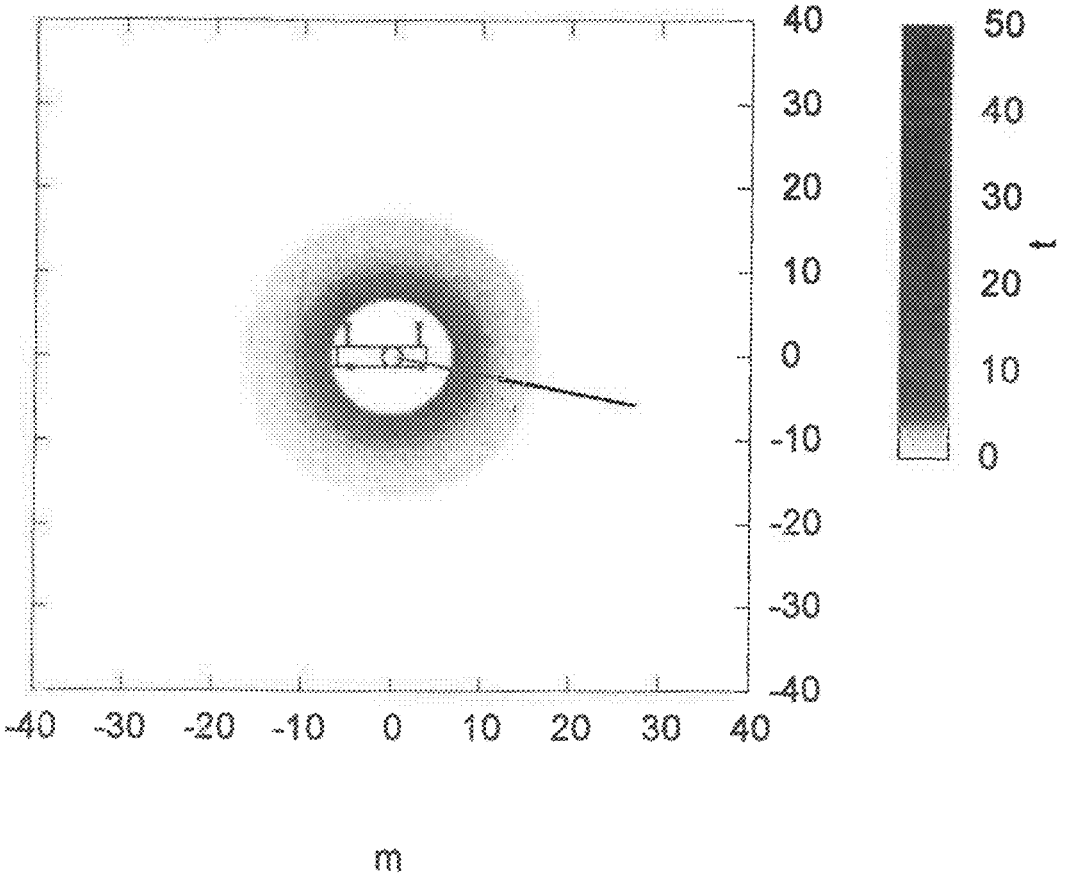
Fig. 3 prior art
Figure 4:
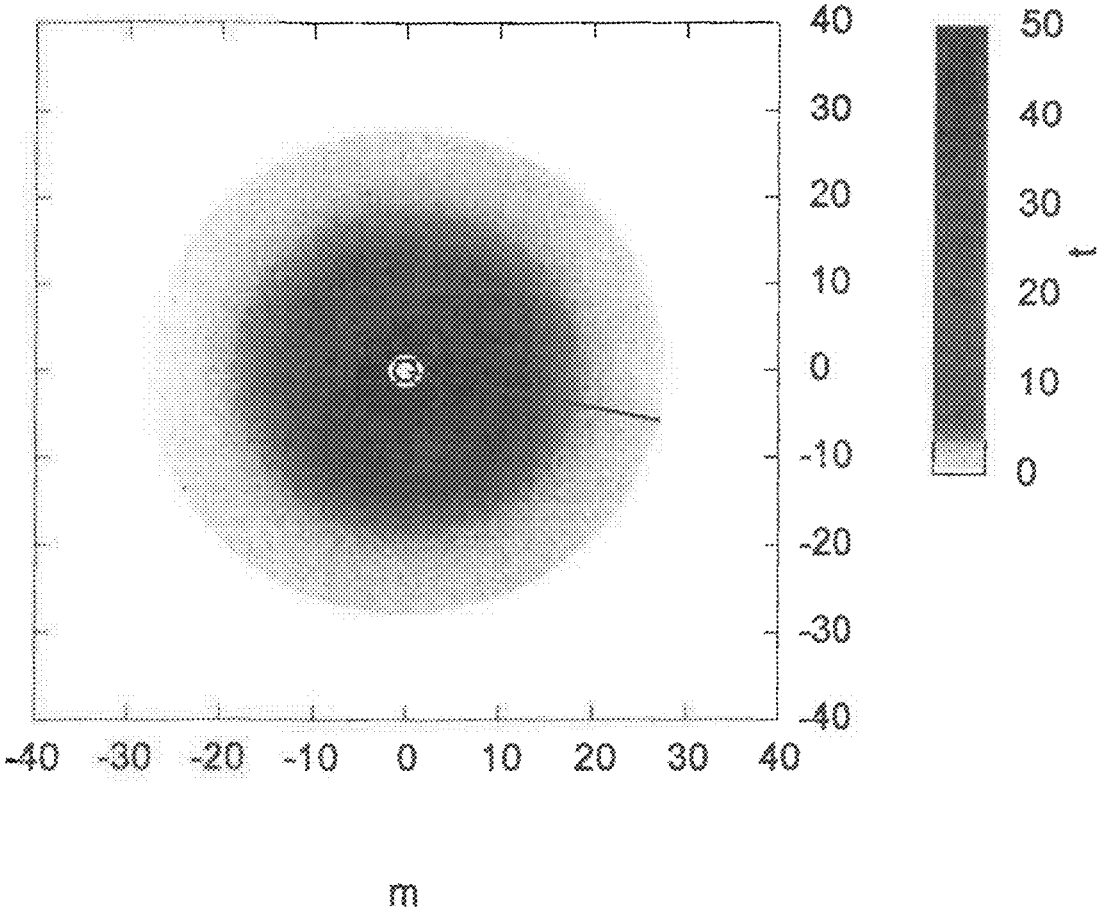
Fig. 4 prior art

The comparisons of FIGS. 3 and 7 as well as 4 and 8 also show very strong improvements. The change can be explained here by the fact that, in a calculation according to the prior art, the minimum in the range around 360° rotation range of the upper carriage is assumed as maximum bearing load for the entire rotation range of the upper carriage. The invention gets away from this manner of thinking, and it can determine the bearing load for each rotation angle position of the upper carriage individually.

Figure 9:
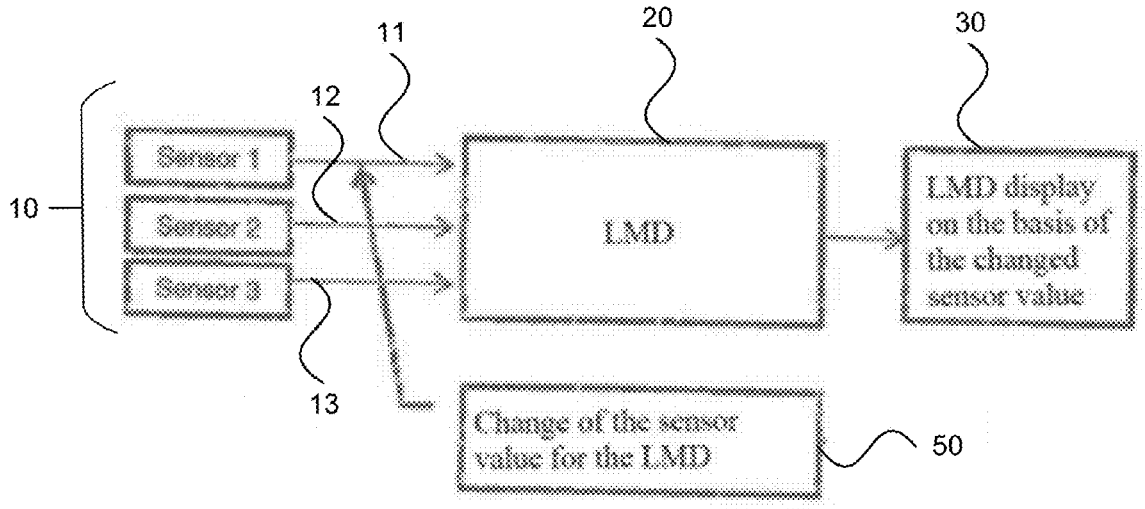
FIG. 9: a diagrammatic representation of the monitoring unit according to the invention, and FIG. 10 a flowchart of the method course according to the invention.

The represented system of FIG. 9 shows a load moment device 20 which, during crane operation, monitors all the crane movements with regard to their safety, and optionally triggers a safety off switch or a limitation of the admissible crane movement. This system can be implemented according to the above-described embodiment of FIGS. 5-8, and it can carry out the presented method according to the invention. The subsequent methods represent an enlargement of this method. However, this is not an obligatory requirement for carrying out the following process steps, which can be carried out independently of the method according to FIGS. 5-8.

During crane operation, the load moment device 20 receives measurement values from a plurality of sensors 10, values which characterize individual parameters during crane operation. It should be pointed out that FIG. 9 shows a number of three sensors only as an example. In a realistic environment, however, the system is based on a plurality of sensors, the number of which is not limited.

The individual measurement values of the sensors 10 characterize, for example, the rotation angle, the luffing angle and/or the cylinder pressure of the luffing cylinder of the crane. On the basis of the provided sensor data, the load moment device calculates the admissible bearing load for the current crane state.

To be able to ensure the safety during crane operation, the crane is to be operated exclusively in the admissible work range. The admissible range is characterized here by the fact that the current bearing load of the crane is lower than the admissible bearing load in the current operating state. If the current bearing load exceeds the admissible value, then the crane is being operated in the inadmissible range.

The aim of the method according to the invention is to achieve that the load moment device triggers a premature braking of the crane movement before entering an inadmissible work range. Moreover, a limited crane movement in the inadmissible range should be made possible under certain circumstances, while a monitoring of the safety of the crane by the load moment device occurs, nevertheless.

For this purpose, the sensor values 11, 12, 13 are modified in a targeted manner in appropriately selected steps, in order to calculate the preview of the admissible bearing load. In the represented embodiment example of FIG. 9, the sensor value 11 of the sensor 1 is manipulated in order to be able to calculate the admissible bearing load for this future parameter, i.e., the future ACTUAL value of the sensor 1. The load moment device 20 calculates, for the changed sensor values, the admissibility of the crane movement and it can therefore estimate when the crane is actuated with maintenance of the current crane movement into an inadmissible range.

Any existing system made of sensors 10 and load moment device 20 can be enlarged by integration of the means 50, in order to be able to carry out a targeted manipulation of at least one sensor value 11.

The load moment device 20 thus calculates in real time on the crane and at any time which admissible bearing loads will occur in the near future in the case of continuation of the currently executed crane movement. With the aid of the predicted development of the bearing load, the load moment device can detect early whether the admissible bearing load converges to the value zero. In this case, the crane movement can be braked or stopped completely in a timely manner. It is also possible to display a corresponding warning notice to the crane operator.

In addition, due to the method according to the invention, a limited crane movement in the inadmissible range can be enabled, movement which is monitored at the same time by the load moment device 20. Care should be taken here to ensure that the load moment device 20 has the task of stopping a crane movement substantially before the occurrence of actual disruptions or of an accident. The operation in the inadmissible range thus does not entail an acute hazard situation, but only the exceeding of a specially defined limit value.

Figure 10:
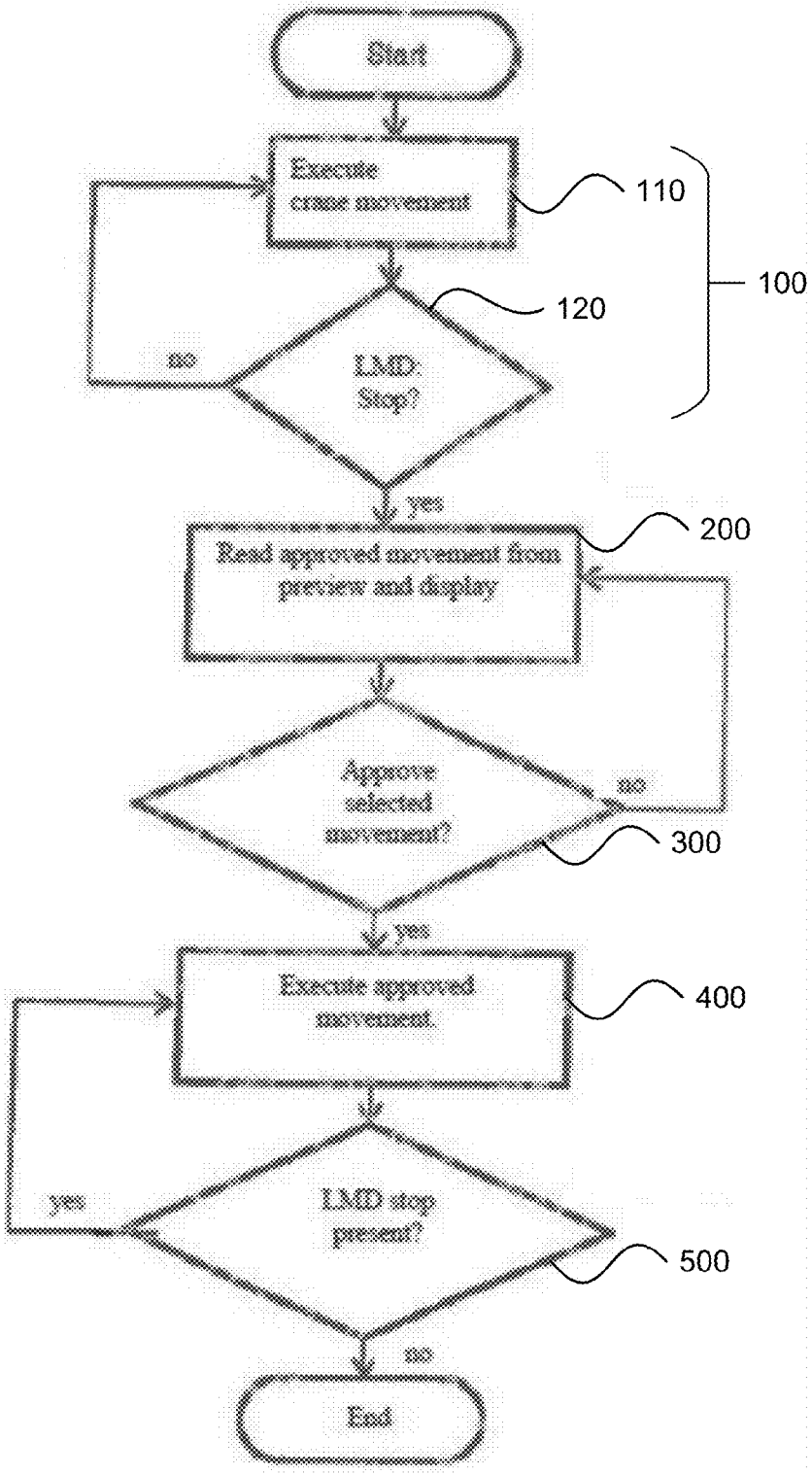

The flowchart of FIG. 10 shows the method according to the invention for the verification of admissible crane movements in the inadmissible range. The state 200 denotes the regular crane operation; the crane movement is carried out in an unimpeded manner in the process step 110, and it is monitored continuously by the load moment device 20 in the block 120 for compliance with the admissible bearing load.

By means of the forward-looking calculation according to the invention of the admissible bearing load, the crane movement can be slowed or stopped completely in a timely manner. If such an emergency stop occurs, the load moment device 20 proceeds to the process step 200. Here, from the calculated preview, it is determined with which crane movement(s) the crane can again be moved out of the inadmissible range in a reliable manner. A possible selection is also displayed for the operator. The crane operator can consequently select the most advantageous variant depending on the situation. In the step 300, the approval of the selected crane movement is verified. As a result, it is ensured that only the crane movements approved by the load moment device and displayed in the step 200 are carried out, and remaining crane movements are blocked.

If the operator selects an approved movement, then said movement is carried out 400 and monitored continuously by the load moment device 500. If the crane movement does not lead to the desired result, i.e., to leaving the inadmissible range, then a new safety stop is triggered by the load moment device. It is only after the inadmissible work range has been left, that the load moment device enters the regular state 100 and unlocks all the crane movements.

The invention claimed is:

1. A method for monitoring the crane safety of a crane with a variable support base and with a monitoring unit, comprising the steps of monitoring several modifiable safety criteria during crane operation, calculating an admissible specific limit value for each criterion which is dependent on at least one modifiable parameter relating to at least one of the crane configuration or crane movement during crane operation, during crane operation is during run-time of the crane, monitoring the thus-calculated specific limit for compliance during crane operation, stopping the crane when the admissible specific limit is reached or exceeded, and calculating a new admissible bearing load based on simulated sensor values for future crane movement and changes to the at least one modifiable parameter, for moving the crane back within the admissible specific limit value during crane operation.

2. The method according to claim 1, wherein the at least one modifiable parameter relating to the crane configuration and/or crane movement during crane operation relates to the variable support base and/or the upper carriage rotation angle.

3. The method according to claim 1, wherein at least one specific limit value is the admissible specific bearing load.

4. The method according to claim 1, wherein one or more previously calculated load charts can be stored on the crane in a retrievable manner, and the charts contain strength-relevant limit values.

5. The method according to claim 1, wherein at least one of the one or more modifiable parameters is a parameter relating to the position of the crane or of a crane component and/or at least one additional of the one or more modifiable parameters is a parameter relating to the jib length, the jib angle, the derrick ballast radius and/or the rotation angle of the slewing ring.

6. The method according to claim 1, wherein rate of the parameter modification is decreased continuously or stepwise before a parameter value is reached at which the actual and admissible bearing loads correspond.

7. The method according to claim 1, wherein by targeted modification of at least one sensor value, a verification is carried out to determine which parameter modification(s) lead(s) to a decrease of the actual bearing load and/or to an increase of the admissible bearing load, and at least one of these parameter modification(s) or crane movements is displayed and/or approved.

8. The method according to claim 1, wherein an integrated crane use planner is used for a diversified crane monitoring.

9. A crane with a monitoring device and a variable support base for carrying out the method according to claim 1.

10. A crane monitoring unit for a crane, in particular load moment device, for carrying out the method according to claim 1.

11. The method according to claim 1, comprising the additional step of approving, limiting or blocking movement of the crane based on calculation of the new admissible bearing load.

12. A method for operating a crane with a monitoring unit which calculates an admissible bearing load dependent on one or more modifiable parameters, during crane operation, and a sensor system which detects a current of the one or more modifiable parameters during crane operation and makes them available to the monitoring unit, wherein one or more sensor values are repeatedly modified during crane operation before the calculation of the admissible bearing load, to determine the admissible bearing load for one or more future parameters, during crane operation is during run-time of the crane, verification is carried out during crane operation as soon as actual bearing load corresponds to or exceeds the admissible bearing load and the monitoring unit stops or limits crane movement, and by targeted modification of at least one sensor value during crane operation, verification is carried out during crane operation to determine which parameter modification(s) lead(s) to a decrease of the actual bearing load or an increase of the admissible bearing load.

13. The method according to claim 12, wherein the admissible total bearing load is calculated from the individual specific limit values or admissible specific bearing loads of the individual criteria.

14. The method according to claim 13, wherein for the calculation of the admissible total bearing load, the criteria are subdivided into at least two different calculation types.

15. The method according to claim 14, wherein in a first step, for each criterion, the admissible bearing load is calculated, and subsequently a minimum of these bearing loads is determined, in a second step, an admissible bearing load for the criteria is determined by iteration, and the iteration preferably starts with the minimum of the bearing load of the criteria.

16. The method according to claim 15, wherein the determination of the bearing load occurs by repeated bisection.

17. The method according to claim 15, wherein the determination of the bearing load occurs by repeated bisection.

18. The method according to claim 12, wherein the monitoring unit modifies the one or more modifiable parameters so that the actual bearing load cannot exceed the calculated admissible bearing load, and the modification of the one or more modifiable parameters is preferably carried out in such a manner that the rate of the parameter modification is decreased continuously or stepwise, or stopped, before a parameter value at which the admissible bearing load corresponds to the actual bearing load is reached.

19. The method according to claim 12, wherein it is combined with a method for monitoring the crane safety of a crane with a variable support base and with a monitoring unit, wherein several safety criteria are monitored during crane operation, and for each criterion which is dependent on at least one of the one or more modifiable parameters relating to the crane configuration and/or crane movement during crane operation, an admissible specific limit value is calculated during crane operation, and monitored for compliance.

20. The method according to claim 19, wherein the at least one of the one or more modifiable parameters relating to the crane configuration and/or movement during crane operation relates to the variable support base and/or upper carriage rotation angle.

21. The method according to claim 19, wherein at least one specific limit value is the admissible specific bearing load.

22. The method according to claim 21, wherein admissible total bearing load is calculated from the individual specific limit values or admissible specific bearing loads of the individual criteria.

23. The method according to claim 22 wherein one or more previously-calculated load charts containing strength-relevant limit values is stored on the crane in retrievable manner.

24. A method for operating a crane with a variable support base and a monitoring unit, comprising the steps of:

executing crane movement in an unimpeded manner (110), continuously monitoring the crane movement by a load moment device (20) for compliance with an admissible bearing load (120), slowing or completely stopping the movement of the crane when the admissible bearing load is approached or exceeded (120), when the crane is stopped because the admissible bearing load is approached, the load moment device (20) proceeding to a process step (200) where, from a calculated preview, the load moment device determines multiple possible crane movements so that the crane can again be moved out of the inadmissible range, displaying a possible selection of the determined crane movements for an operator, selecting one of the movements of the crane by the operator, verifying approval of the selected crane movement (300), carrying out (400) only the crane movement displayed (200) and approved (300) by the load moment device (20), and blocking remaining crane movement(s).

25. The method of claim 24, comprising the additional steps of continuously monitoring (500) the selected and approved crane movement by the load moment device (20), when the displayed and approved crane movement fails to move the crane out of the inadmissible range, triggering a new safety stop by the load moment device (20), and unlocking (100) all possible crane movement by the load moment device (20) only after the crane has moved out of the inadmissible range.

* * * * *